United States Patent [19]

Clark et al.

[11] Patent Number: 5,041,036

[45] Date of Patent: Aug. 20, 1991

[54] IDLE EXHAUST GAS RELIEF ARRANGEMENT FOR OUTBOARD MOTOR

[75] Inventors: Danny I. Clark; John C. Hervat; Norman C. Franke, all of Kenosha, Wis.

[73] Assignee: Outboard Marine Corporation, Waukegan, Ill.

[21] Appl. No.: 491,959

[22] Filed: Mar. 12, 1990

[51] Int. Cl.[5] ..... B63H 21/26

[52] U.S. Cl. ..... 440/89; 60/324

[58] Field of Search ..... 440/88, 89, 900; 55/DIG. 30; 123/195 C; 181/198, 204, 212, 228, 232, 243, 264, 269, 270, 272; 60/272, 317, 316, 324

[56] References Cited

U.S. PATENT DOCUMENTS

| | | | |
|---|---|---|---|
| 3,310,022 | 3/1967 | Kollman | 440/89 |
| 3,577,952 | 5/1971 | Tado | 440/89 |
| 4,145,988 | 3/1979 | Harada | 440/89 |
| 4,303,401 | 12/1981 | Sanmi et al. | 440/88 |
| 4,354,849 | 10/1982 | Sanmi et al. | 440/88 |
| 4,421,490 | 12/1983 | Nakahama | 440/89 |
| 4,604,069 | 8/1986 | Taguchi | 440/88 |
| 4,607,723 | 8/1986 | Okazaki | 131/272 |
| 4,668,199 | 5/1987 | Freund et al. | 440/89 |
| 4,795,383 | 1/1989 | Binversie et al. | 440/89 |
| 4,799,905 | 1/1989 | Broughton et al. | 440/89 |
| 4,887,692 | 12/1989 | Outani | 440/89 |
| 4,950,191 | 8/1990 | Wenstadt | 440/89 |
| 4,955,838 | 9/1990 | Wenstadt | 440/89 |
| 4,963,110 | 10/1990 | Otani | 440/89 |

*Primary Examiner*—Joseph F. Peters, Jr.
*Assistant Examiner*—Clifford T. Bartz
*Attorney, Agent, or Firm*—Michael, Best & Friedrich

[57] ABSTRACT

Disclosed herein is an outboard motor comprising an internal combustion engine including a lower surface having therein an exhaust gas discharge port, a drive shaft housing having an upper end including an upper face fixed to the lower surface of the internal combustion engine, an outer surface extending downwardly from the upper face, an interior vertically extending main exhaust gas passage extending from the upper face and communicating with the exhaust gas discharge port, an idle exhaust gas relief passage recessed in the upper face and in spaced relation to the main exhaust gas passage, and closed by the lower surface of the internal combustion engine, and an idle exhaust gas outlet port located in the outer surface and communicating with the idle exhaust gas relief passage, and an idle exhaust gas relief tube communicating between the main exhaust gas passage and the idle exhaust gas relief passage and having a portion extending vertically within the main exhaust gas passage and terminating in spaced relation above the water level in the drive shaft housing when the drive shaft housing is located in a normal operating position and when the drive shaft housing is at rest relative to the water.

13 Claims, 1 Drawing Sheet

IDLE EXHAUST GAS RELIEF ARRANGEMENT FOR OUTBOARD MOTOR

BACKGROUND OF THE INVENTION

1. Field of the Invention

The invention relates generally to outboard motors and, more particularly, to arrangements for discharging or relieving exhaust gases during idle or low speed operation when the outboard motor is in the normal running position and is either at rest or moving through the water at a low speed.

2. Reference to the Prior Art

When an outboard motor is running at relatively high speeds, exhaust gas is normally discharged underwater through the gear case or through a snout near the bottom end of the drive shaft housing. Such discharge occurs, in part, due to the speed of travel of the outboard motor through the water and, as a consequence, in general, the interior of the exhaust passage in the drive shaft housing is void of water.

When an outboard motor is at rest or when an outboard motor is running through water at slow speeds, water enters into the exhaust gas passage of the drive shaft housing and rises therein to a level approximating the water level outside the drive shaft housing. As a consequence, the exhaust gases are "bottled-up" in the drive shaft housing and an idle exhaust gas relief passage has been provided in the past to afford escape of the exhaust gases at a point in the drive shaft housing located above the normal water level.

Attention is directed to the following U.S. Pat. Nos.:

| | | |
|---|---|---|
| 3,310,022 | Kollman | March 21, 1967 |
| 3,577,952 | Tado | May 11, 1971 |
| 4,145,988 | Harada | March 27, 1979 |
| 4,303,401 | Sanmi, et al. | December 1, 1981 |
| 4,354,849 | Sanmi, et al. | October 19, 1982 |
| 4,421,490 | Nakahama | December 20, 1983 |
| 4,604,069 | Taguchi | August 5, 1986 |
| 4,607,723 | Okazaki | August 26, 1986 |
| 4,668,199 | Freund, et al. | May 26, 1987 |
| 4,795,383 | Binversie, et al. | January 3, 1989 |
| 4,799,905 | Broughton, et al. | January 24, 1989 |

SUMMARY OF THE INVENTION

The invention provides an outboard motor comprising an internal combustion engine including a lower surface having therein an exhaust gas discharge port, a drive shaft housing having an upper end including an upper face fixed to the lower surface of the internal combustion engine, an outer surface extending downwardly from the upper face, an interior vertically extending main exhaust gas passage extending from the upper face and communicating with the exhaust gas discharge port, an idle exhaust gas relief passage recessed in the upper face and in spaced relation to the main exhaust gas passage and closed by the lower surface of the internal combustion engine, and an idle exhaust gas outlet port located in the outer surface and communicating with the idle exhaust gas relief passage, and an idle exhaust gas relief conduct communicating between the main exhaust gas passages and the idle exhaust gas relief passage and having a portion extending vertically within the main exhaust gas passage.

The invention also provides an outboard motor comprising an internal combustion engine including a side, a lower surface having a forward half and a rearward half, and also having therein an exhaust gas discharge port located adjacent the side of the engine and in the rearward half of the lower surface, a drive shaft housing having an upper end including an upper face fixed to the lower surface of the engine, an outer surface extending downwardly from the upper face and including a rearwardly located and generally horizontally extending surface portion, an interior vertically extending main exhaust gas passage extending from the upper face and located in alignment with the forward half of the lower surface, an exhaust gas branch passage recessed in the upper face and communicating between the exhaust gas discharge port in the lower surface of the engine and the main exhaust gas passage, an idle exhaust gas relief passage recessed in the upper face and in spaced relation to the main exhaust gas passage and closed by the lower surface of the internal combustion engine, which idle exhaust gas relief passage comprises first, second and third expansion chambers with the first and second expansion chambers communicating through a first restricted port and with the second and third expansion chambers communicating through a second restricted port, and an idle exhaust gas relief outlet port located in the outer surface and communicating between the third expansion chamber and the atmosphere, and an idle exhaust gas relief tube communicating between the main exhaust gas passage and the idle exhaust gas relief passage and having a portion extending vertically within the main exhaust gas passage in off-center relation thereto, and terminating in spaced relation above the water level in the drive shaft housing when the drive shaft housing is located in a normal operating position and when the drive shaft housing is at rest relative to the water.

Other features and advantages of the invention will become apparent to those skilled in the art upon review of the following detailed description, claims, and drawings.

Figure 1:
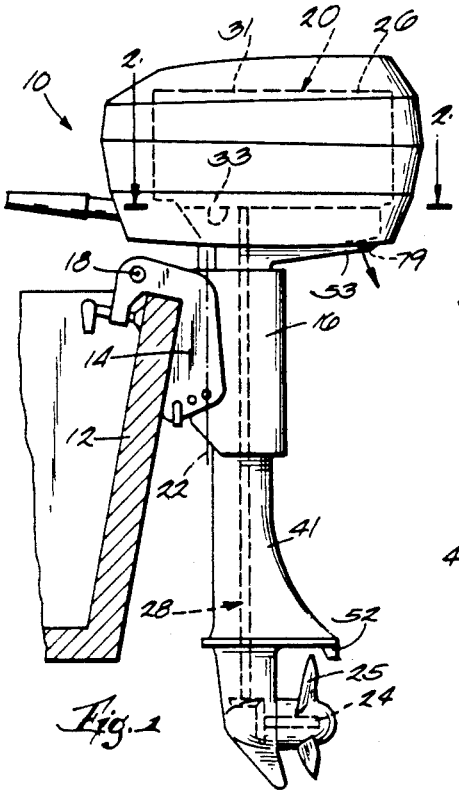
FIG. 1 is a side elevational view, partially in section, of a marine propulsion device embodying various of the features of the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Shown in FIG. 1 is a marine propulsion device which is in the form of an outboard motor 10 and which comprises a mounting assembly mounted on the transom 12 of a boat. While various suitable mounting assemblies can be used, in the illustrated construction, the mounting assembly includes a transom bracket 14 fixedly mounted on the transom 12, and a swivel bracket 16 mounted on the transom bracket 14 for pivotal movement relative thereto about a generally horizontal tilt axis 18.

The marine propulsion device or outboard motor 10 also comprises a propulsion unit 20 mounted on the swivel bracket 16 for pivotal movement relative thereto about a generally vertical steering axis 22, and for common movement therewith about the tilt axis 18. The propulsion unit 20 includes a rotatably mounted propeller shaft 24 carrying a propeller 25, and an internal combustion engine 26 (shown schematically in FIG. 1) drivingly connected to the propeller 25 by a conventional drive train 28.

The engine 26 includes an engine or cylinder block 31 including a lower surface 33 having therein an exhaust gas discharge port 35. While other constructions can be employed, in the disclosed construction, the discharge port 35 is located at the left or starboard side of the engine block 31, about two-thirds of the way from the front to the rear. Fixed to the engine block 31 and forming a part of the propulsion unit 20 is a drive shaft housing 41 having an upper end 43 including an upper face 45 engaging the lower surface 33 of the engine block 31. The upper end 43 of the drive shaft housing 41 also includes a flange 47 having therein a series of apertures 49 through which extend a series of bolts which are threaded into the engine or cylinder block 31 to fix the drive shaft housing 41 to the engine or cylinder block 31.

The drive shaft housing 41 includes an exterior surface 51 which extends downwardly from the upper face 45 and which, at the rear, includes a generally horizontally extending surface portion 53. In addition, the drive shaft housing 41 defines a main exhaust gas discharge passage 61 which extends downwardly from the upper face 45 and, at its lower end, communicates with an exhaust gas passage (not shown) which can be located in a gear case fixed to the lower end of the drive shaft housing 41 or can be provided by a snout or opening 52 formed in the drive shaft housing 41.

The main exhaust gas passage 61 is, in general, centered on a fore and aft center line 63 at a location about one-third of the distance from the front to the rear.

The drive shaft housing 41 also includes a main exhaust gas branch passage 65 which is recessed in the upper face 45 of the drive shaft housing 41, which communicates with the main exhaust passage 61, and which includes a portion 67 located in communicating alignment with the exhaust gas discharge port 35 in the lower surface 33 of the engine or cylinder block 31. Accordingly, exhaust gas flow is from the discharge port 35 in the engine or cylinder block 31 to the branch passage 65 and then to the main passage 61.

The upper face 45 of the drive shaft housing 41 is additionally recessed to provide an idle exhaust gas relief passage or recess 71 including first, second and third expansion chambers 73, 75 and 77, respectively, and one or more idle exhaust gas relief outlet port(s) 79 communicating between the third expansion chamber 77 and the atmosphere and terminating at the downwardly facing, horizontal surface portion 53 of the exterior surface 51 of the drive shaft housing 41.

Figure 2:
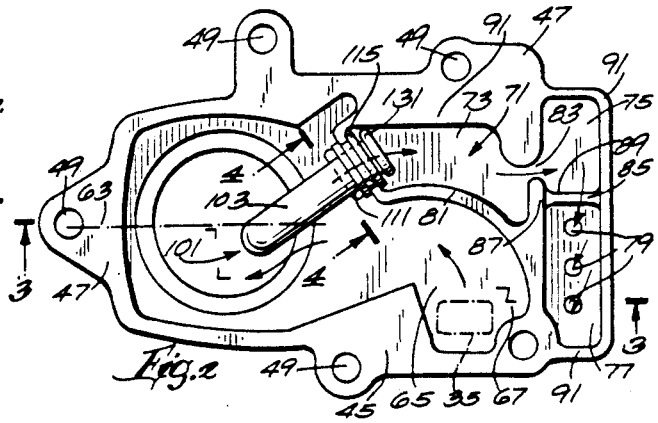
FIG. 2 is an enlarged view taken along line 2—2 of FIG. 1.
Figure 3:
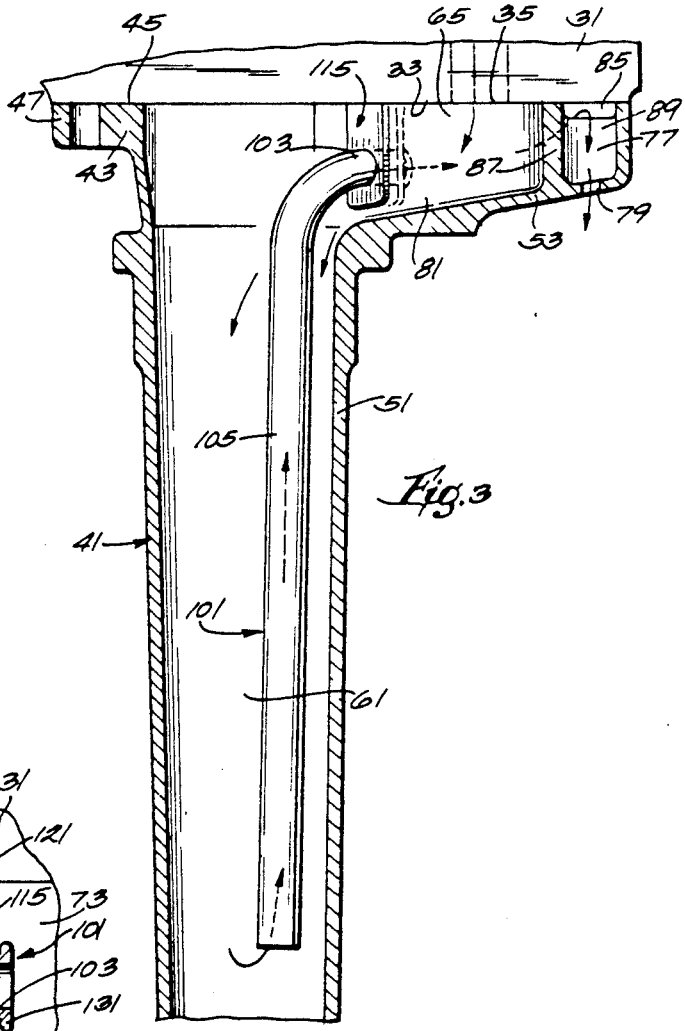
FIG. 3 is a fragmentary sectional view taken along line 3—3 of FIG. 2.
Figure 6:
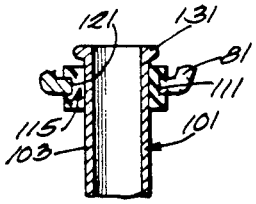
FIG. 6 is a sectional view taken along line 6—6 of FIG. 4.
Figure 4:
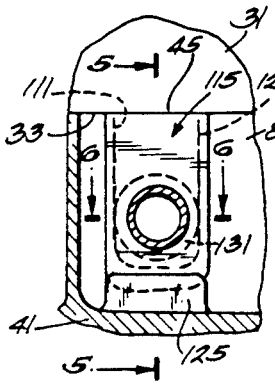
FIG. 4 is an enlarged and fragmentary sectional view taken along line 4—4 of FIG. 2.
Figure 5:
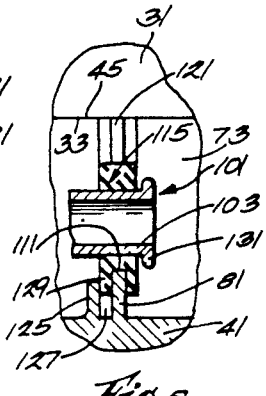
FIG. 5 is a sectional view taken along line 5—5 of FIG. 4.

As shown best in FIG. 2, the first idle exhaust gas expansion chamber 71 is separated from the exhaust gas branch passage 65 by a wall 81 which, except as hereinafter explained, is unbroken and which extends to the lower surface 33 of the engine block 31, whereby to isolate and separate the exhaust gas in the branch passage 65 from the exhaust gas in the idle exhaust gas relief passage 71.

The first and second idle exhaust gas expansion chambers 73 and 75 communicate with each other through a narrow slot or port or opening 83 having a restricted area or size, which area or size is of much smaller size than the adjacent cross sections in the first and second expansion chambers 73 and 75.

The second and third expansion chambers 75 and 77 communicate with each other through another vertically extended narrow slot or port or opening 85 having a restricted area or size, which area or size is of much small cross section than the adjacent cross sections in the second and third expansion chambers 75 and 77.

Still further, in particular, the second and third expansion chambers 75 and 77 are separated from the first expansion chamber 73 by a vertically extending wall 87 which extends to the lower surface 33 of the engine block 31, and which, in part, defines the first slot 83. The second and third expansion chambers 75 and 77 are defined, in part, by a vertically extending wall 89 which extends in adjacently spaced relation to the lower surface 33 of the engine block 31, and which defines the second slot 85. The first, second, and third expansion chambers 73, 75 and 77 are further defined by vertical walls 91 which extend to the lower surface 33 of the engine block 31, and which, in general, complete definition of the recess or recessed area 71 which is subdivided as just explained to define the first, second, and third expansion chambers 73, 75 and 77.

The engine 26 also includes an idle exhaust gas relief conduit in the form of a tube or pipe 101 which is generally of inverted L-shape having an upper horizontal leg 103 which has one end extending through the wall 81 and communicating with the first expansion chamber 73 and which includes another end communicating with the upper end of an integrally formed vertical leg 105 extending downwardly in the main exhaust gas passage 61 in off-center relation thereto and to a location slightly above the water level when the drive shaft housing 41 is in the normal running position and when the drive shaft housing 41 is at rest, i.e., not moving through the water. The idle exhaust gas relief tube or pipe 101 has a cross section which is much smaller than the adjacent cross section of the main exhaust gas passage 61 and the adjacent cross section of the first expansion chamber 73.

Passage of the idle exhaust gas tube or pipe 101 through the wall 81 and retention of the idle exhaust tube or pipe 101 in position in the drive shaft housing 41 is provided by forming the wall 81 with upwardly open slot 111 into which is tightly fitted a grommet 115 which is fabricated of suitable material, such as rubber, and which includes an aperture which tightly receives the idle exhaust gas tube or pipe 101. Preferably, the grommet 115 is fixedly retained by the wall 81 by means including a peripheral slot 121 which is formed in the grommet 115 and which receives the edge or margin of the slot 111 in the wall 81. If desired, the floor of the exhaust gas branch passage 65 can be provided with a parallel rib 125 which, together with the wall 81, forms a groove 127 receiving a portion 129 of the grommet 115.

In addition, the idle exhaust relief tube or pipe 101 preferably includes, at the end thereof, in the first expansion chamber 73, a flange 131 which serves to prevent withdrawal of the upper or horizontal leg 103 of the idle exhaust gas pipe 101 from the grommet 115.

When the drive shaft housing 41 is fixed to the engine or cylinder block 31, the lower surface 33 thereof engages the upper face 45 of the drive shaft housing 41 including the upper ends of the walls 81, 87, and 91 to isolate and separate the idle exhaust gas relief passage 71 from the exhaust gas branch passage 65, except, as already explained, for the communication afforded by the idle exhaust gas relief tube 101, and, except for the slots 83 and 85, to isolate and separate from each other the first, second and third expansion chambers 73, 75, and 77. As shown, the recessed area which defines the idle exhaust gas relief passage 71 progressively decreases in depth in the rearward direction so that the depth of the idle exhaust gas relief passage 71 is greater at the front end thereof and is smaller at the rearward end thereof.

In operation, exhaust gas traveling from the engine cylinder or cylinders (not shown) leaves the engine or cylinder block 31 through the discharge port 35 and flows through the described branch passage 65 to the main exhaust gas passage 61 and downwardly therein. When the outboard motor 10 is in the normal running position and when the outboard motor 10 is at rest, i.e., not traveling through the water, or is traveling slowly through the water, the exhaust gas travel is, at least to some extent, blocked by the water in the drive shaft housing 41. Consequently, the exhaust gas travels upwardly through the idle exhaust gas relief tube or pipe 101 and serially through the first, second and third expansion chambers 73, 75 and 77 and is thereafter discharged to the atmosphere through the downwardly open outlet port(s) 79. The employment of a series of expansion chambers communicating through restricted openings or ports, as disclosed, provides not only the idle exhaust gas relief passage 71 but also provides a muffling effect which materially lowers the sound associated with the discharge of the idle exhaust gas.

Various of the features of the invention are set forth in the following claims.

We claim:

1. An outboard motor comprising an internal combustion engine including a lower surface having therein an exhaust gas discharge port, a drive shaft housing having an upper end including an upper face fixed to said lower surface of said internal combustion engine, an outer surface extending downwardly from said upper face, an interior vertically extending main exhaust gas passage extending from said upper face and communicating with said exhaust gas discharge port, an idle exhaust gas relief passage recessed in said upper face and in spaced relation to said main exhaust gas passage, and closed by said lower surface of said internal combustion engine, and an idle exhaust gas outlet port located in said outer surface and communicating with said idle exhaust gas relief passage, and an idle exhaust gas relief conduit which is separate from said drive shaft housing, which communicates between said main exhaust gas passage and said idle exhaust gas relief passage, and which has a portion extending vertically within said main exhaust gas passage.

2. An outboard motor in accordance with claim 1 wherein said vertically extending portion of said idle exhaust gas relief conduit is located off-center within said vertically extending main exhaust gas passage.

3. An outboard motor in accordance with claim 1 wherein said engine includes a side and wherein said engine lower surface includes a forward half and a rearward half, wherein said exhaust gas discharge port is located adjacent said side of said engine and in said rearward half of said lower surface, wherein said main exhaust gas passage is located in alignment with said forward half of said lower surface, and wherein said drive shaft housing further includes an exhaust gas branch passage recessed in said upper face and communicating between said exhaust gas discharge port in said lower surface of said engine and said main exhaust gas passage.

4. An outboard motor in accordance with claim 3 wherein said exhaust gas branch passage and said idle exhaust gas relief passage are separated by a vertically extending wall.

5. An outboard motor in accordance with claim 4 wherein said idle exhaust gas relief passage comprises first, second and third expansion chambers with said first and second expansion chambers communicating through a first restricted port and with said second and third expansion chambers communicating through a second restricted port, and wherein said outlet port communicates between said third expansion chamber and the atmosphere, and wherein said exhaust gas relief conduit comprises a tube passing through said vertical wall and communicating with said first expansion chamber.

6. An outboard motor comprising an internal combustion engine including a lower surface having therein an exhaust gas discharge port, a drive shaft housing having an upper end including an upper face fixed to said lower surface of said internal combustion engine, an outer surface extending downwardly from said upper face, said outer surface including a rearwardly located and generally horizontally extending surface portion, an interior vertically extending main exhaust gas passage extending from said upper face and communicating with said exhaust gas discharge port, an idle exhaust gas relief passage recessed in said upper face and in spaced relation to said main exhaust gas passage, and closed by said lower surface of said internal combustion engine, and an idle exhaust gas outlet port located in said outer surface and communicating with said idle exhaust gas relief passage, said idle exhaust gas outlet port being located in said surface portion, and an idle exhaust gas relief conduit communicating between said main exhaust gas passage and said idle exhaust gas relief passage and having a portion extending vertically within said main exhaust gas passage.

7. An outboard motor comprising an internal combustion engine including a side, a lower surface having a forward half and a rearward half, and also having therein an exhaust gas discharge port located adjacent said side of said engine and in said rearward half of said lower surface, a drive shaft housing having an upper end including an upper face fixed to said lower surface of said engine, an outer surface extending downwardly from said upper face and including a rearwardly located and generally horizontally extending surface portion, an interior vertically extending main exhaust gas passage extending from said upper face and located in alignment with said forward half of said lower surface, an exhaust gas branch passage recessed in said upper face and communicating between said exhaust gas discharge port in said lower surface of said engine and said main exhaust gas passage, an idle exhaust gas relief passage recessed in said upper face and in spaced relation to said main exhaust gas passage and closed by said lower surface of said internal combustion engine, said idle exhaust gas relief passage comprising first, second and third expansion chambers with said first and second expansion chambers communicating through a first restricted port and with said second and third expansion chambers communicating through a second restricted port, and an idle exhaust gas relief outlet port located in said outer surface and communicating between said third expansion chamber and the atmosphere, and an idle exhaust gas relief tube communicating with said idle exhaust gas relief passage and having a portion extending vertically within said main exhaust gas passage in off-center relation thereto, and terminating in spaced relation above the water level in said drive shaft housing when said drive shaft housing is located in a normal operating position and when said drive shaft housing is at rest relative to the water.

8. An outboard motor in accordance with claim 7 wherein said exhaust gas branch passage and said idle exhaust gas relief passage are separated by a vertically extending wall.

9. An outboard motor in accordance with claim 8 wherein said exhaust gas relief tube passes through said vertical wall and communicates with said first expansion chamber.

10. An outboard motor comprising an internal combustion engine including a lower surface having therein an exhaust gas discharge port, a drive shaft housing having an upper end including an upper face fixed to said lower surface of said internal combustion engine, an outer surface extending downwardly from said upper face, an interior vertically extending main exhaust gas passage extending from said upper face and communicating with said exhaust gas discharge port, an idle exhaust gas relief passage recessed in said upper face and in spaced relation to said main exhaust gas passage, and closed by said lower surface of said internal combustion engine, said idle exhaust gas relief passage comprising first, second, and third expansion chambers with said first and second expansion chambers communicating through a first restricted port and with said second and third expansion chambers communicating through a second restricted port, and an idle exhaust gas outlet port which is located in said outer surface and which communicates between said third expansion chamber and the atmosphere, and an idle exhaust gas relief conduit communicating between said main exhaust gas passage and said idle exhaust gas relief passage and having a portion extending vertically within said main exhaust gas passage.

11. An outboard motor in accordance with claim 10 wherein said engine includes a side and wherein said engine lower surface includes a forward half and a rearward half, wherein said exhaust gas discharge port is located adjacent said side of said engine and in said rearward half of said lower surface, wherein said main exhaust gas passage is located in alignment with said forward half of said lower surface, and wherein said drive shaft housing further includes a exhaust gas branch passage recessed in said upper face and communicating between said exhaust gas discharge port in said lower surface of said engine and said main exhaust gas passage.

12. An outboard motor in accordance with claim 11 wherein said exhaust gas branch passage and said idle exhaust gas relief passage are separated by a vertically extending wall.

13. An outboard motor in accordance with claim 12 wherein said exhaust gas relief conduit comprises a tube passing through said vertical wall and communicating with said first expansion chamber.

* * * * *